US007065824B2

(12) United States Patent
Petner

(10) Patent No.: US 7,065,824 B2
(45) **Date of Patent: *Jun. 27, 2006**

(54) CLEANING IMPLEMENT WITH REMOVABLE CLEANING ELEMENT

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/990,807

(22) Filed: Nov. 17, 2004

(65) Prior Publication Data

US 2005/0086756 A1 Apr. 28, 2005

Related U.S. Application Data

(63) Continuation of application No. 10/140,465, filed on May 7, 2002, now Pat. No. 6,820,301.

(51) Int. Cl.
*B25G 3/12* (2006.01)

(52) U.S. Cl. ..... 15/145; 16/422; 403/305

(58) Field of Classification Search ..... 15/145; 16/422, 429, 436, DIG. 41; 403/300–305, 403/326, 329, 365, 368, 370
See application file for complete search history.

(56) References Cited

U.S. PATENT DOCUMENTS

| | | | |
|---|---|---|---|
| 34,687 | A | 3/1862 | Horton |
| 47,642 | A | 5/1865 | Homes |
| 112,556 | A | 3/1871 | David |
| 349,678 | A | 9/1886 | Applegate |
| 538,269 | A | 4/1895 | Neagles |
| 798,172 | A | 8/1905 | Ducret |
| 1,182,288 | A | 5/1916 | Mack |
| 1,229,843 | A | 6/1917 | Whitaker |
| 1,420,639 | A | 6/1922 | Sturgis |
| 1,530,225 | A | 3/1925 | Belakoy |
| 1,934,910 | A | 11/1933 | Buhr |
| 3,423,781 | A | 1/1969 | Henson |
| 3,600,735 | A | 8/1971 | Jerabek |
| 3,682,516 | A | 8/1972 | Savage |
| 3,795,934 | A | 3/1974 | Moss |
| 4,132,489 | A | 1/1979 | Berg, Jr. et al. |
| 4,433,931 | A | 2/1984 | Malish et al. |
| 4,524,484 | A | 6/1985 | Graham |
| 4,541,139 | A | 9/1985 | Jones et al. |

(Continued)

*Primary Examiner*—Mark Spisich
(74) *Attorney, Agent, or Firm*—Wildman, Harrold, Allen & Dixon LLP

(57) ABSTRACT

Disclosed is a cleaning implement with a removable cleaning element comprising a base member having a first end with an annular toothed edge and at least one resilient retention member positioned intermediate the toothed edge and a second end of the base member, each resilient retention member having a stop surface facing the second end. An annular locking member is movably mounted on the base member, the locking member having an inner wall surface and at least one ledge projecting from the inner wall surface and adapted to abut the retention member stop surface. The inner wall surface of the locking member further includes a threaded portion intermediate an end of the locking member and the ledge. Also included is a cleaning element mounting member having an annular toothed edge for complementary engagement with the toothed edge of the base member and an outer wall surface with a threaded portion for threaded engagement with the threaded portion of the locking member. A cleaning element in the form of a mop head may be secured to the mounting member. The cleaning implement may be movably secured to an elongated handle.

25 Claims, 3 Drawing Sheets

U.S. PATENT DOCUMENTS

| | | | |
|---|---|---|---|
| 4,642,837 | A | 2/1987 | Nichols et al. |
| 4,648,738 | A | 3/1987 | Thielen |
| 4,794,663 | A | 1/1989 | Vosbikian |
| 5,037,235 | A | 8/1991 | Aquilina |
| 5,161,278 | A | 11/1992 | Tomm |
| 5,172,447 | A | 12/1992 | Tomm |
| 5,358,524 | A | 10/1994 | Richelsoph |
| 5,579,848 | A | 12/1996 | Hsu |
| 5,890,254 | A | 4/1999 | Courtney et al. |
| 5,924,816 | A | 7/1999 | Schuele |
| 5,940,933 | A | 8/1999 | Chang |
| 5,970,567 | A | 10/1999 | Hirse |
| 6,006,399 | A | 12/1999 | Massaro |
| 6,029,308 | A | 2/2000 | Smith |
| 6,115,869 | A | 9/2000 | Libman |
| 6,125,494 | A | 10/2000 | Morad |
| 6,247,199 | B1 | 6/2001 | Petner |
| 6,254,303 | B1 | 7/2001 | Falat et al. |
| 6,279,961 | B1 | 8/2001 | Stoltz |
| 2001/0013150 | A1 | 8/2001 | Specht |

CLEANING IMPLEMENT WITH REMOVABLE CLEANING ELEMENT

CROSS REFERENCE TO RELATED APPLICATION

This application is a continuation of U.S. patent application Ser. No. 10/140,465, filed May 7, 2002, now U.S. Pat. No. 6,820,301, issued Nov. 23, 2004.

The present invention relates to a cleaning implement having a cleaning element mounted on a removable mounting member.

BRIEF DESCRIPTION OF THE DRAWINGS

In the drawings illustrating embodiments of the present invention.

DETAILED DESCRIPTION OF THE INVENTION

Figure 1:
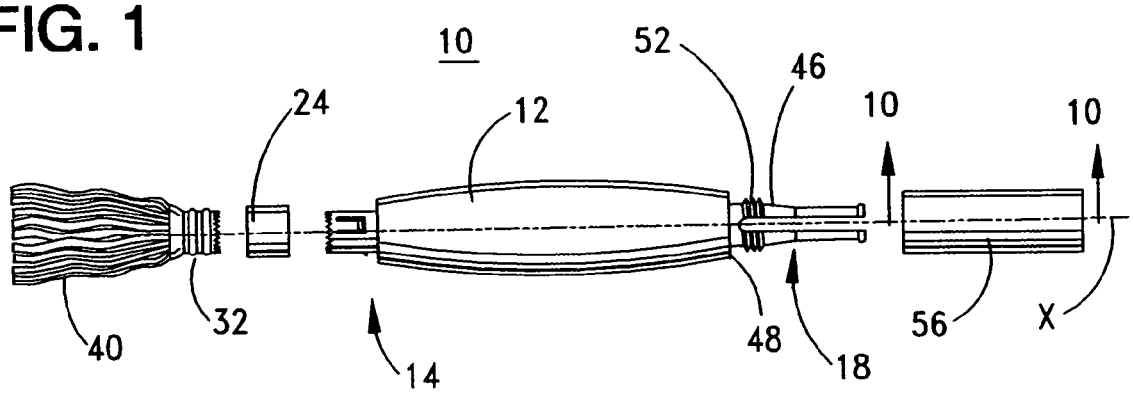
FIG. 1 is an exploded view of the cleaning implement of the present invention.
Figure 2:
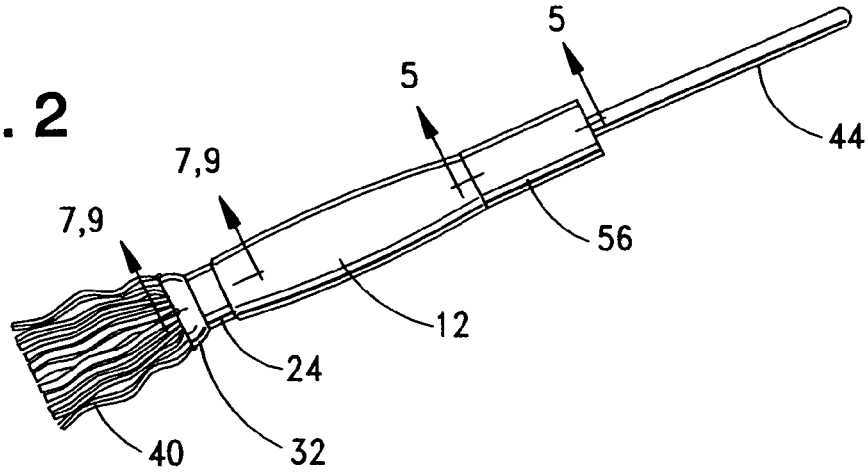
FIG. 2 is a perspective view showing the cleaning implement fully assembled and secured to an elongated handle.

Referring to FIGS. 1 and 2, cleaning implement 10 comprises a base member 12, a locking member 24, and a cleaning element mounting member 32 having a cleaning element 40 secured thereto. Cleaning element 40 may comprise a mop head, a bristle head of a broom, a squeegee or one of many other types of such cleaning elements. Base member 12 includes a first end 14 and a second end 18. In a first embodiment, base member 12 is of a generally annular construction defining a bore into which an elongated handle 44 is received so that base member 12 may be movably secured to handle 44. Alternatively, the cleaning implement may be used without being secured to the handle.

Figure 3:
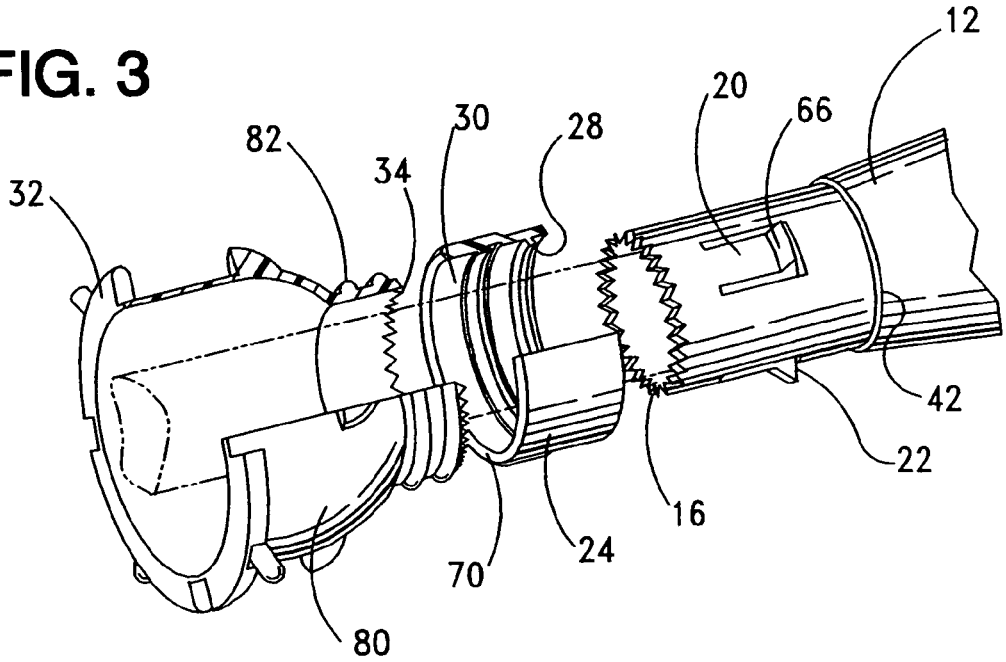
FIG. 3 is an exploded partial cutaway view of a first embodiment of the cleaning implement.

Referring to FIGS. 1 and 3, an annular locking member 24 is movably mounted on base member 12. Locking member 24 has an inner wall surface and at least one ledge 28 projecting from the inner wall surface. Ledge 28 is adapted to abut retention member stop surfaces 22 when cleaning implement 10 is fully assembled. The inner wall surface of locking member 24 also includes a threaded portion 30 proximate an end of the locking member and between an end 70 of locking member 24 and ledge 28.

As seen more clearly in FIG. 3, retention members 20 may have a cantilevered beam construction. Alternatively, retention members 20 may be supported at both ends, the portions of the retention members residing between the ends being designed to deflect under an applied load. Each resilient retention member 20 has a stop surface 22 facing second end 18. Stop surface 22 extends generally perpendicularly with respect to a longitudinal axis X of base member 12 (FIG. 1) and is configured for abutting locking member ledge 28 projecting from an inner wall surface of locking member 24, to be described in greater detail later. Each retention member 20 may also include an inclined surface 66 positioned between stop surface 22 and toothed edge 16. In a first embodiment of the cleaning implement shown in FIG. 3, a plurality of resilient retention members 20 is spaced evenly around an outer surface of first end 14.

Figure 5:
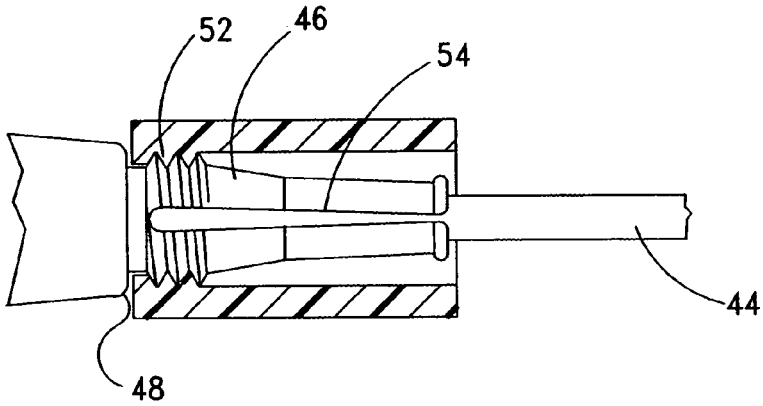
FIG. 5 is a cross-sectional view of a second end of the cleaning implement secured to a handle.

Referring to FIGS. 1, 2 and 5, if base member 12 is to be movably secured to elongated handle 44, base member second end 18 may include an annular portion 46 and a shoulder 48 intermediate annular portion 46 and retention members 20. Annular portion 46 has an outer wall surface including a threaded portion 52 proximate shoulder 48 and one or more slots 54 extending along annular portion 46 from base member second end 18 generally toward base member first end 14 and extending into threaded portion 52 of second end 18. Due to the presence of slots 54, parts of annular portion 46 adjacent the slots are unsupported and, therefore, relatively resilient.

Referring to FIGS. 1 and 3, an annular locking member 24 is movably mounted on base member 12. Locking member 24 has an inner wall surface and at least one ledge 28 projecting from the inner wall surface. Ledge 28 is adapted to abut retention member stop surfaces 22 when cleaning implement 10 is fully assembled. The inner wall surface of locking member 24 also includes a threaded portion 30 proximate an end of the locking member and between an end 78 of locking member 24 and ledge 28.

Mounting member 32 includes an outer wall surface 80 and an annular toothed edge 34 for complementary engagement with toothed edge 16 of base member 12. Outer wall surface 80 has a threaded portion 82 for threaded engagement with threaded portion 30 of locking member 24, in a manner described in greater detail later. A cleaning element 40 is secured to mounting member 32 using any one of a variety of known methods. Generally, cleaning element 40 is permanently affixed to mounting member 32 to produce a unitary cleaning element sub-assembly.

Figure 10:
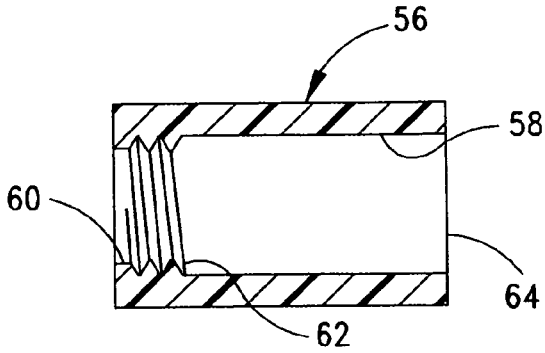
FIG. 10 is a cross-sectional view of a second locking member as seen in FIG. 5.

As seen in FIGS. 1 and 2, if base member 12 is to be movably secured to elongated handle 44, a second annular locking member 56 is movably mounted on base member 12 along annular portion 46. Referring to FIG. 10, second locking member 56 has an inner wall surface 58 and at least one ledge 60 projecting from inner wall surface 58. Ledge 60 is adapted to abut shoulder 48 when cleaning implement 10 is assembled, thereby restricting movement of second locking member 56 along base member 12. A threaded portion 62 extends along inner wall surface 58 intermediate an end 64 of second locking member 56 and ledge 60 for threaded engagement with threaded portion 52 of the annular portion outer wall surface (see FIG. 1).

The steps involved in assembling cleaning implement 10 will now be discussed. Referring to FIGS. 5 and 10, to secure base member 12 to handle 44, handle 44 is inserted into base member and second locking member threaded portion 62 is placed in contact with base member second end threaded portion 52 to enable engagement between the threaded portions. Second locking member 56 is then rotated with respect to base member second end threaded portion 52 to engage second locking member threaded portion 62. Engagement between threaded portion 52 of the annular portion outer wall surface and second locking member threaded portion 62 causes annular portion 46 on either side of slots 54 into compressive contact with elongated handle 44. This contact secures base member 12 to elongated handle 44.

Figure 6:
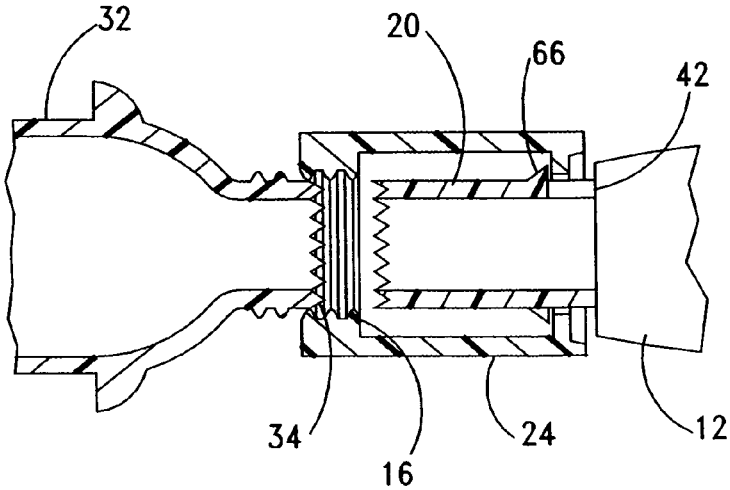
FIG. 6 is a cross-sectional view of the embodiment of the cleaning implement of FIG. 3 partially assembled.

Referring to FIGS. 1, 3 and 6, to assemble locking member 24 to base member 12, locking member 24 is placed over base member first end 14 such that first end 14 extends through locking member 24. Locking member 24 is urged toward base member second end 18 until it engages inclined surfaces 66 (if present), causing unsupported portions of retention members 20 to deflect inward toward handle 44. Locking member 24 thus slides over retention members 20 toward second end 18 of base member 12 until locking member 24 has passed over retention members 20, allowing retention members 20 to return to their undeflected states. At this point, movement of locking member 24 back toward base member first end 14 will eventually bring locking member ledge 28 in abutting contact with stop surfaces 22, thereby preventing further movement of locking member 24 in that direction. In addition, movement of locking member 24 toward base member second end 18 will eventually bring locking member ledge 28 in abutting contact with shoulder 42, thereby preventing further movement of locking member 24 in that direction. Movement of locking member 24 on base member 12 is thereby restricted to within a range between retention members 20 and shoulder 42, as indicated by dimension Y shown in FIG. 3.

Figure 7:
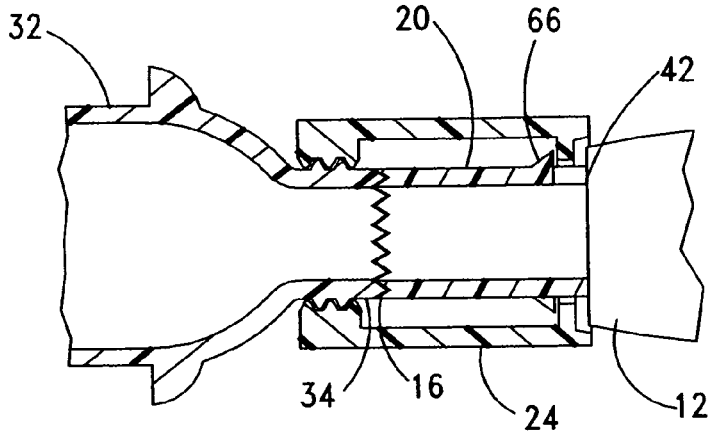
FIG. 7 is a cross-sectional view of the embodiment of the cleaning implement of FIG. 3 fully assembled.

Referring to FIG. 7, in a first embodiment mounting member 32 is removably attached to base member 12 as follows. Threaded portion 82 of mounting member 32 is brought into contact with threaded portion 30 of locking member 24. As a user holds mounting member 32 in contact with locking member 24, locking member 24 is rotated with respect to mounting member 32, causing locking member threaded portion 30 to engage corresponding threaded portion 82 on mounting member 32, thereby urging mounting member 32 toward base member 12. As mounting member 32 moves toward base member 12, mounting member toothed edge 34 moves toward engagement with base member toothed edge 16 and locking member ledge 28 moves toward, and eventually comes into contact with, stop surfaces 22 of retention members 20.

When mounting member toothed edge 34 and base member toothed edge 16 become engaged (i.e., when the teeth of one toothed edge extend at least partially into corresponding cavities in the other toothed edge), rotation of mounting member 32 with respect to base member 12 will be substantially restricted to a degree depending on the depth of the engagement and the sizes of the teeth. At the point where teeth of one toothed edge extend completely into corresponding cavities in the other toothed edge, rotation of mounting member 32 with respect to base member 12 should be prevented completely.

As rotation of locking member 24 continues past the point at which the toothed edges become completely engaged, locking member ledge 28 is urged toward stop surfaces 22 on retention members 20 until locking member ledge 28 comes into contact with stop surfaces 22. When locking member ledge 28 abuts stop surfaces 22 and base member toothed edge 16 is completely engaged with mounting member toothed edge 34, mounting member 32 is removably secured to base member 12.

As noted above, cleaning element 40 is generally permanently affixed to mounting member 32 to produce a unitary cleaning element assembly. When it is desired to replace the cleaning element, mounting member 32 is disengaged from base member 12 and discarded. A new cleaning element assembly is then attached to base member 12 as described above. To remove mounting member 32 to which a used cleaning element is attached, locking member 24 is rotated about base member 12 in a direction appropriate to disengage the threaded portions of locking member 24 and mounting member 32. Rotation is continued until the locking member and mounting member threaded portions become completely disengaged, enabling a user to remove mounting member 32 from locking member 24.

Figure 4:
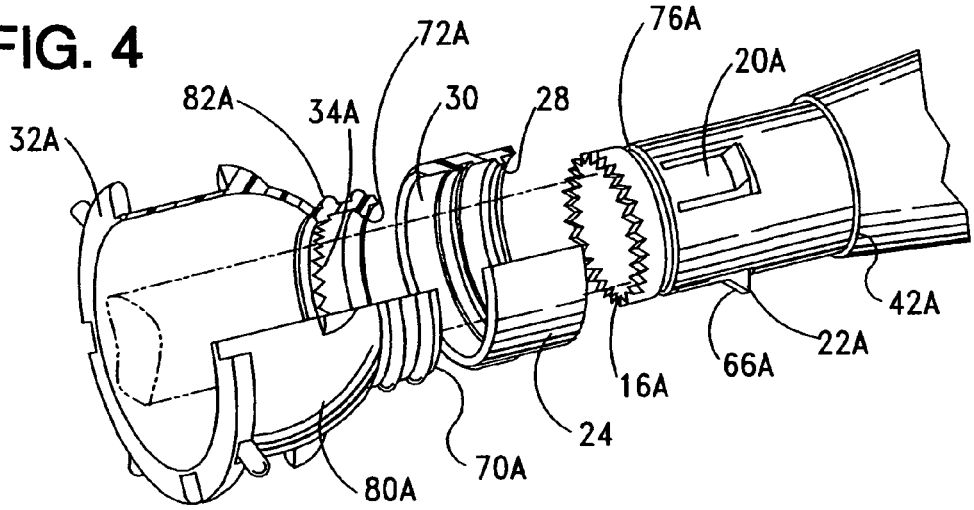
FIG. 4 is an exploded partial cutaway view of a second embodiment of the cleaning implement.

The structure of a second embodiment of the invention will now be described. Referring to FIG. 4, mounting member annular toothed edge 34A projects from an inner wall surface of mounting member 32A between a first end 80A and a second end 70A of mounting member 32A. In this embodiment, a detent system may be incorporated to maintain toothed edges 16A and 34A in engagement during engagement of locking member threaded portion 30 with mounting member threaded portion 82A. The detent system comprises at least one ledge 72A projecting from the inner wall surface of mounting member 32A intermediate toothed edge 34A and end 80A of mounting member 32A, and a groove 76A positioned in an outer wall surface of base member 12A between toothed edge 16A and retention members 20A.

Groove 76A is configured to receive ledge 72A therein such that a snap-fit is created between groove 76A and ledge 72A when toothed edges 34A and 16A are engaged, thereby maintaining toothed edges 34A and 16A in an engaged position while locking member 24 is rotated by a user to engage locking member threaded portion 30 with mounting member threaded portion 82A.

Figure 8:
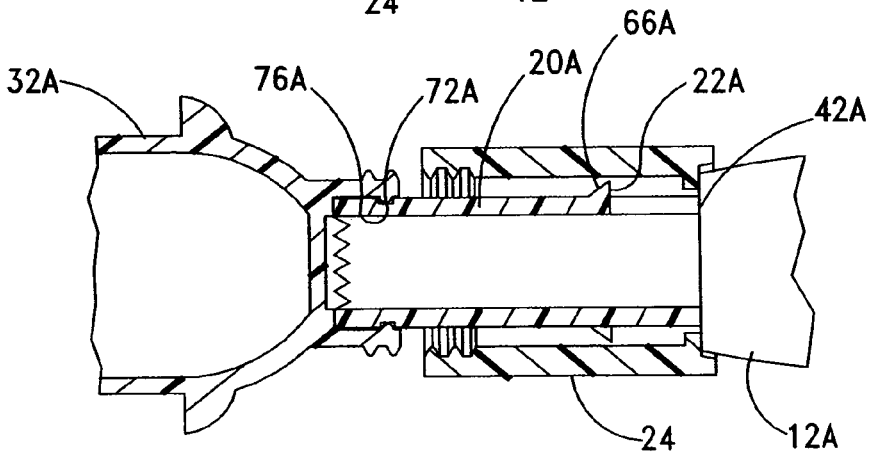
FIG. 8 is a cross-sectional view of the embodiment of the cleaning implement of FIG. 4 partially assembled.
Figure 9:
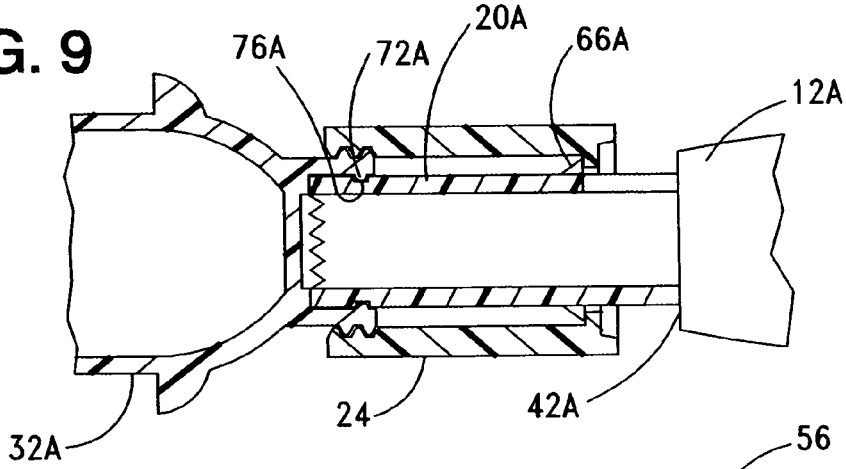
FIG. 9 is a cross-sectional view of the embodiment of the cleaning implement of FIG. 4 fully assembled.

Assembly of the second embodiment will now be described. Referring to FIGS. 4, 8 and 9, mounting member toothed edge 34A and base member toothed edge 16A are engaged prior engagement of locking member threaded portion 30 with mounting member threaded portion 82A. In this embodiment, mounting member 32A is removably attached to base member 12A as follows. Base member first end 12A is inserted into mounting member 32A as shown in FIG. 7 to bring base member toothed edge 16A into engagement with mounting member toothed edge 34A. As base member toothed edge 16A engages mounting member toothed edge 34A, mounting member ledge 72A also engages base member groove 76A in a snap fit.

Engagement between mounting member ledge 72A and base member groove 76A acts to maintain the engagement between the toothed edges of mounting member 32A and base member first end 14A, eliminating the need for a user to hold the toothed edges in contact during application of locking member threaded portion 30 to mounting member threaded portion 82A. At this point, locking member 24 either abuts shoulder 42A or resides in a position recessed from base member first end 14A such that it does not interfere with engagement between the mounting member toothed edge 34A and the base member toothed edge 16A After the base member and mounting member toothed edges are engaged, locking member 24 is brought into contact with mounting member 32A so as to enable locking member threaded portion 30 to engage mounting member threaded portion 82A. Locking member 24 is then rotated so as to engage locking member threaded portion 30 and mounting member threaded portion 82A. As rotation continues, locking member ledge 28 is urged toward stop surfaces 22A of retention members 20A. When locking member ledge 28 abuts stop surfaces 22A and base member toothed edge 16A is engaged with mounting member toothed edge 34A, mounting member 32A is removably secured to base member 12A.

It should be understood that the preceding is merely a detailed description of one embodiment of this invention and that numerous changes to the disclosed embodiment can be made in accordance with the disclosure herein without departing from the spirit or scope of the invention. The preceding description, therefore, is not meant to limit the scope of the invention. Rather, the scope of the invention is to be determined only by the appended claims and their equivalents.

That which is claimed is:

1. A connector assembly for a cleaning implement, comprising:

a base member defining at least one recess adapted to receive a projection and defining a stop extending in a direction generally transverse to a longitudinal axis of the base member, wherein said stop is mounted to a moveable portion of said base member spaced apart from said at least one recess, and said moveable portion of said base member is moveable in a direction generally transverse to a longitudinal axis of the base member;

a locking member defining a ledge member adapted to abut the stop and defining a threaded portion; and a cleaning element mounting member defining at least one projection adapted to be received by the recess and defining a threaded portion adapted for threaded engagement with the threaded portion of the locking member.

2. The connector assembly of claim 1 wherein the moveable portion of said base member comprises a resilient retention member.

3. The connector assembly of claim 1 wherein the stop defines a surface which faces in a direction opposite to a direction of the cleaning element mounting member with threaded engagement of the threaded portions of the locking member and the mounting member.

4. The connector assembly of claim 1 wherein the base member defines at least two stops.

5. The connector assembly of claim 1 wherein the at least one recess includes a plurality of recesses positioned between a plurality of teeth shaped projections.

6. The connector assembly of claim 5 wherein the plurality of teeth shaped projections are positioned in an annular configuration and positioned generally parallel to a longitudinal axis of the base member.

7. The connector assembly of claim 1 wherein the base member includes a generally tubular construction.

8. The connector assembly of claim 1 wherein the base member defines a shoulder spaced apart from the stop and adapted to abut the locking member.

9. The connector assembly of claim 1 wherein the base member defines a groove.

10. The connector assembly of claim 9 wherein the groove is positioned between the at least one recess and the stop.

11. The connector assembly of claim 9 wherein the cleaning element mounting member defines a ledge adapted to engage the groove.

12. The connector assembly of claim 1 wherein the ledge member of the locking member is constructed as an annular projection.

13. The connector assembly of claim 1 wherein the locking member includes a generally annular construction.

14. The connector assembly of claim 1 wherein the locking member is positionable over an exterior surface of the base member.

15. The connector assembly of claim 1 wherein the projection is in a tooth shaped configuration.

16. The connector assembly of claim 15 includes a plurality of tooth shaped configurations.

17. The connector assembly of claim 16 wherein the plurality of tooth shaped configurations are positioned in an annular configuration.

18. The connector assembly of claim 17 wherein the plurality of tooth shaped configurations are positioned on an edge of the cleaning element mounting member.

19. The connector assembly of claim 17 wherein the plurality of tooth shaped configurations are positioned spaced apart from an edge of the cleaning element mounting member.

20. The connector assembly of claim 1 wherein the threads of the cleaning element mounting member are positioned on an exterior surface of the cleaning element mounting member.

21. The connector assembly of claim 20 wherein the threads of the locking member are positioned on an interior surface of the locking member.

22. The connector assembly of claim 1 wherein the mounting member includes a tubular construction.

23. The connector assembly of claim 1 wherein the base, locking and mounting members are constructed with an opening defined in each member wherein the openings are adapted to receive a handle of a cleaning implement.

24. The connector assembly of claim 1 wherein a cleaning element is secured to the mounting member.

25. The connector assembly of claim 1 wherein the base member includes the recess positioned at one end and at least one slot defined by the base member positioned at an opposing end wherein the slot extends in a direction generally along a length of the base member, wherein the base member is adapted to receive a second locking member and wherein the second locking member is adapted to apply a force to the opposing end in a direction generally transverse to the direction in which the at least one slot extends.

* * * * *